US010363184B2

(12) United States Patent
Zerhusen et al.

(10) Patent No.: US 10,363,184 B2
(45) Date of Patent: Jul. 30, 2019

(54) PATIENT SUPPORT APPARATUS HAVING URINARY DRAINAGE BAG LOCKOUT FEATURE

(71) Applicant: Hill-Rom Services, Inc., Batesville, IN (US)

(72) Inventors: Robert M Zerhusen, Cincinnati, OH (US); Richard H. Heimbrock, Cincinnati, OH (US); Richard J. Schuman, Cary, NC (US); Daniel McCoy, Wilmette, IL (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 15/804,065

(22) Filed: Nov. 6, 2017

(65) Prior Publication Data

US 2018/0185222 A1 Jul. 5, 2018

Related U.S. Application Data

(60) Provisional application No. 62/441,706, filed on Jan. 3, 2017.

(51) Int. Cl.
*A61G 7/02* (2006.01)
*A61G 7/05* (2006.01)
(Continued)

(52) U.S. Cl.
CPC ..... *A61G 7/0503* (2013.01); *A61G 7/005* (2013.01); *A61G 7/015* (2013.01); *A61G 7/018* (2013.01);
(Continued)

(58) Field of Classification Search
CPC ..... A61G 7/02
(Continued)

(56) References Cited

U.S. PATENT DOCUMENTS 5,527,007 A * 6/1996 Weilbacher ..... A61G 7/0503 248/215
5,715,548 A 2/1998 Weismiller et al.
(Continued)

FOREIGN PATENT DOCUMENTS

EP 2918255 A1 9/2015
EP 2974705 A1 1/2016
(Continued)

OTHER PUBLICATIONS

Japanese Office Action for Japanese Patent Application No. 2017-241666, dated Dec. 11, 2018, 7 pages.
(Continued)

*Primary Examiner* — Fredrick C Conley
(74) *Attorney, Agent, or Firm* — Barnes & Thornburg LLP

(57) ABSTRACT

A patient support apparatus includes an upper frame that is movable to raise and lower relative to a base frame frame. A mattress support deck is coupled to the upper frame and includes a foot deck section. The foot deck section is movable with respect to the rest of the mattress support deck to raise and lower. A drainage bag support is coupled to the foot deck section and is configured to support a drainage bag. Control circuitry controls movement of the upper frame and the foot deck section. The control circuitry has a lockout mode to limit the movement of the upper frame and foot deck section to prevent the drainage bag from touching a floor.

24 Claims, 11 Drawing Sheets

(51) Int. Cl.
*A61G 7/005* (2006.01)
*A61G 7/015* (2006.01)
*A61G 7/018* (2006.01)

(52) U.S. Cl.
CPC ..... *A61G 7/02* (2013.01); *A61G 7/0509* (2016.11); *A61G 7/0524* (2016.11); *A61G 2203/12* (2013.01); *A61G 2203/16* (2013.01); *A61G 2203/20* (2013.01); *A61G 2203/70* (2013.01); *A61G 2205/20* (2013.01)

(58) Field of Classification Search
USPC ..... 5/604, 600
See application file for complete search history.

(56) References Cited

U.S. PATENT DOCUMENTS

| | | | |
|---|---|---|---|
| 6,163,903 | A | 12/2000 | Weismiller et al. |
| 6,336,235 | B1 | 1/2002 | Ruehl |
| 6,876,303 | B2 | 4/2005 | Reeder et al. |
| 7,017,208 | B2 | 3/2006 | Weismiller et al. |
| 7,237,287 | B2 | 7/2007 | Weismiller et al. |
| 7,319,386 | B2 | 1/2008 | Collins, Jr. et al. |
| 7,443,302 | B2 | 10/2008 | Reeder et al. |
| 7,480,951 | B2 | 1/2009 | Weismiller et al. |
| 7,538,659 | B2 | 5/2009 | Ulrich et al. |
| 7,568,246 | B2 | 8/2009 | Weismiller et al. |
| 7,784,128 | B2 | 8/2010 | Kramer |
| 8,026,821 | B2 | 9/2011 | Reeder et al. |
| 8,065,764 | B2 | 11/2011 | Kramer |
| 8,258,965 | B2 | 9/2012 | Reeder et al. |
| 8,413,274 | B2 | 4/2013 | Weismiller et al. |
| 8,487,774 | B2 | 7/2013 | Reeder et al. |
| 8,766,804 | B2 | 7/2014 | Reeder et al. |
| 9,230,421 | B2 | 1/2016 | Reeder et al. |
| 9,463,126 | B2 | 10/2016 | Zerhusen et al. |
| 9,666,061 | B2 | 5/2017 | Reeder et al. |
| 2002/0059679 | A1 | 5/2002 | Weismiller et al. |
| 2002/0138905 | A1* | 10/2002 | Bartlett ..... A61G 7/001 5/607 |
| 2004/0011779 | A1 | 1/2004 | Krywiczanin et al. |
| 2007/0210917 | A1 | 9/2007 | Collins, Jr. et al. |
| 2009/0212925 | A1 | 8/2009 | Schuman, Sr. et al. |
| 2009/0212926 | A1 | 8/2009 | Du et al. |
| 2009/0217080 | A1 | 8/2009 | Ferguson et al. |
| 2012/0073054 | A1* | 3/2012 | O'Keefe ..... A61G 7/018 5/618 |
| 2016/0136356 | A1* | 5/2016 | Ribble ..... G06F 19/3418 604/111 |

FOREIGN PATENT DOCUMENTS

| | | | |
|---|---|---|---|
| JP | 08033682 | A | 2/1996 |
| JP | 2004195248 | A | 7/2004 |
| WO | 2015032003 | A1 | 3/2015 |

OTHER PUBLICATIONS

Extended European Search Report for European Patent Application No. 17207497.3 dated Jun. 25, 2018; 7 pages.

* cited by examiner

PATIENT SUPPORT APPARATUS HAVING URINARY DRAINAGE BAG LOCKOUT FEATURE

CROSS-REFERENCE TO RELATED APPLICATIONS

The present application claims priority to U.S. Provisional Patent Application Ser. No. 62/441,706, filed Jan. 3, 2017 and titled "PATIENT SUPPORT APPARATUS HAVING URINARY DRAINAGE BAG LOCKOUT FEATURE," the text and drawings of which are incorporated herein by reference in their entirety.

BACKGROUND

The present disclosure relates to a patient support apparatus. More specifically, the present disclosure relates to a patient support apparatus having a structure to support a urinary drainage bag.

Some patient support apparatuses such as hospital beds have a support for a urinary drainage bag, sometimes referred to as a Foley bag, to receive urine from a catheter inserted in the patient. The drainage bag may be attached to a frame of the hospital bed for example. In addition to including a drainage bag, the hospital bed may include various other features, for example, controls to move the bed and/or portions of the bed. Some hospital beds include the ability to lower the foot end of the bed to assist a patient in exiting the bed, to place the bed in a reverse Trendelenburg position, or to place the patient in a seated position.

Unfortunately, as the foot end of the bed is lowered, the drainage bag may come in contact with the floor, thereby exposing the drainage bag to contaminants on the floor. Such contaminants may result in catheter-associated urinary tract infections (CAUTI) in the patient. CAUTI may be caused by contaminants entering the bag and traveling to the catheter site. Alternatively, contaminants may be transferred from the bag to a healthcare provider, i.e. the provider's gloves, who then inserts, removes, or maintains a catheter. CAUTI are a leading, costly healthcare associated condition. CAUTI protocols now call for the prevention of drainage bags touching the floor.

SUMMARY

The present disclosure includes one or more of the features recited in the appended claims and/or the following features which, alone or in any combination, may comprise patentable subject matter:

According to a first aspect of the present disclosure, a patient support apparatus may include a frame that may have a first portion and a second portion. The first portion may be movable to raise and lower relative to the second portion. A drainage bag support may be coupled to the first portion of the frame to move therewith. Control circuitry may be provided to control movement of the first portion of the frame. The control circuitry may have a lockout mode to prevent movement of the first portion of the frame relative to the second portion of the frame so that, if a drainage bag is coupled to the drainage bag support, the first portion is unable to be moved to place the drainage bag in an unwanted position.

In some embodiments, the frame may include a mattress support deck including a foot deck section and the foot deck section may comprise the first portion of the frame. The control circuitry, when operating in the lockout mode, may prevent lowering of the foot deck section if the foot deck section is positioned at an angle greater than a predetermined angle with respect to the second portion of the frame. Alternatively or additionally, the control circuitry, when operating in the lockout mode, may allow lowering of the foot deck section if the foot deck section is positioned at an angle less than the predetermined angle and may prevent lowering of the foot deck section when the predetermined angle is met. In some embodiments, the foot deck section may include a first foot deck section portion and a second foot deck section portion that is extendable and retractable relative to the first foot deck section portion. The drainage bag support may be coupled to the second foot deck section portion.

In some embodiments, the frame may include an upper frame and a base frame. The upper frame may comprise the first portion of the frame and the base frame may comprise the second portion of the frame. The control circuitry, when operating in the lockout mode, may allow movement of the upper frame to raise the upper frame relative to the base frame and may prevent movement of the upper frame to lower the upper frame relative to the base frame.

If desired, the patient support apparatus may further include an interface electrically coupled to the control circuitry. The interface may display an indicator to indicate whether or not the control circuitry is operating in the lockout mode. The interface may further display a warning that movement of the first portion of the frame is locked if a user engages the control circuitry to lower the first portion of the frame when the control circuitry is operating in the lockout mode. Alternatively or additionally, the interface may further display a warning that movement of the first portion of the frame could cause the drainage bag to move to the unwanted position if a user engages the control circuitry to lower of the first portion of the frame when the control circuitry is not operating in the lockout mode.

In some embodiments, the patient support apparatus may further include a sensor to sense whether the drainage bag is coupled to the drainage bag support. The control circuitry may be placed in the lockout mode automatically in response to the sensor sensing that the drainage bag is coupled to the drainage bag support. Alternatively or additionally, the control circuitry may operate to prompt a user to place the control circuitry in the lockout mode in response to the sensor sensing that the drainage bag is coupled to the drainage bag support.

The unwanted position of the drainage bag may comprise the drainage bag touching a floor. In some embodiments, the patient support apparatus may have a user input that may be coupled to the movable portion and that may be successively engaged by a user to turn the lockout mode on and off.

According to another aspect of the present disclosure, a patient support apparatus may have a frame including a base frame and an upper frame supported above the base frame. The upper frame may be movable to raise and lower relative to the base frame. A mattress support deck may be coupled to the upper frame. The mattress support deck may have a foot deck section that may be movable to raise and lower relative to the upper frame. A drainage bag support may be coupled to the foot deck section and may be configured to support a drainage bag. Control circuitry may be provided to control movement of the upper frame and the foot deck section. The control circuitry may have a lockout mode to limit movement of the upper frame relative to the base frame and to limit movement of the foot deck section so that, if a drainage bag is coupled to the drainage bag support, the upper frame and foot deck section are unable to be moved to place the drainage bag in an unwanted position.

In some embodiments, the control circuitry, when operating in the lockout mode, may prevent lowering of the foot deck section if the foot deck section is positioned at an angle greater than 12 degrees with respect to the upper frame. Alternatively or additionally, the control circuitry, when operating in the lockout mode, may allow movement of the upper frame to raise relative to the base frame and may prevent movement of the upper frame to lower relative to the base frame.

In some embodiments, the patient support apparatus may further include an interface electrically coupled to the control circuitry. The interface may display an indicator to indicate whether or not the control circuitry is operating in the lockout mode. The interface may further display a warning that the control circuitry is operating in the lockout mode if a user engages the control circuitry to lower the upper frame or lower the foot deck section in a manner that is limited by the lockout mode. Alternatively or additionally, the interface may further display a warning that movement of the upper frame or movement of the foot deck section could cause the drainage bag to move to the unwanted position if a user engages the control circuitry to lower the upper frame or lower the foot deck section when the control circuitry is not operating in the lockout mode.

Optionally, the patient support apparatus may further comprise a sensor to sense whether the drainage bag is coupled to the drainage bag support. The control circuitry may be placed in the lockout mode automatically in response to the sensor sensing that the drainage bag is coupled to the drainage bag support. Alternatively or additionally, the control circuitry may operate to prompt a user to place the control circuitry in the lockout mode in response to the sensor sensing that the drainage bag is coupled to the drainage bag support.

As was the case in the first aspect of the present disclosure, the unwanted position of the drainage bag may comprise the drainage bag touching a floor in the second aspect of the present disclosure. Also in the second aspect of the present disclosure, a user input may be coupled to the movable portion and may be successively engaged by a user to turn the lockout mode on and off.

According to yet another aspect of the present disclosure, a method of controlling a patient support apparatus may include determining whether a drainage bag may be coupled to a movable portion of a frame of the patient support apparatus; placing control circuitry of the patient support apparatus in a lockout mode; and preventing lowering of the movable portion of the frame when the control circuitry is in the lockout mode to prevent the drainage bag from touching a floor.

In some embodiments, the method may further include preventing movement of the movable portion of the frame if the movable portion is positioned at an angle greater than a predetermined angle with respect to a second portion of the frame. The method may further include displaying a warning that movement of the movable portion is locked if a user engages an input to the control circuitry to lower the movable portion. If desired, the method may further include sensing whether the drainage bag is coupled to the movable portion with a sensor.

In some embodiments, the lockout mode is controlled by a graphical user interface. The interface may direct a caregiver to a settings menu that provides an explanation of the lockout mode as well as controls for activating and deactivating the lockout mode. Additionally, the interface may provide warnings to the caregiver that a drainage bag is in danger of touching the floor, if the lockout mode is off. Options may also be provided to enable certain support apparatus articulations when the lockout mode is on. Such articulations are controlled to prohibit the drainage bag from contacting the floor during support apparatus movements. In some embodiments, a button is provided adjacent the drainage bag support to activate or deactivate the lockout mode. In some embodiments, a sensor added to the drainage bag support activates the lockout mode in response to sensing a drainage bag.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
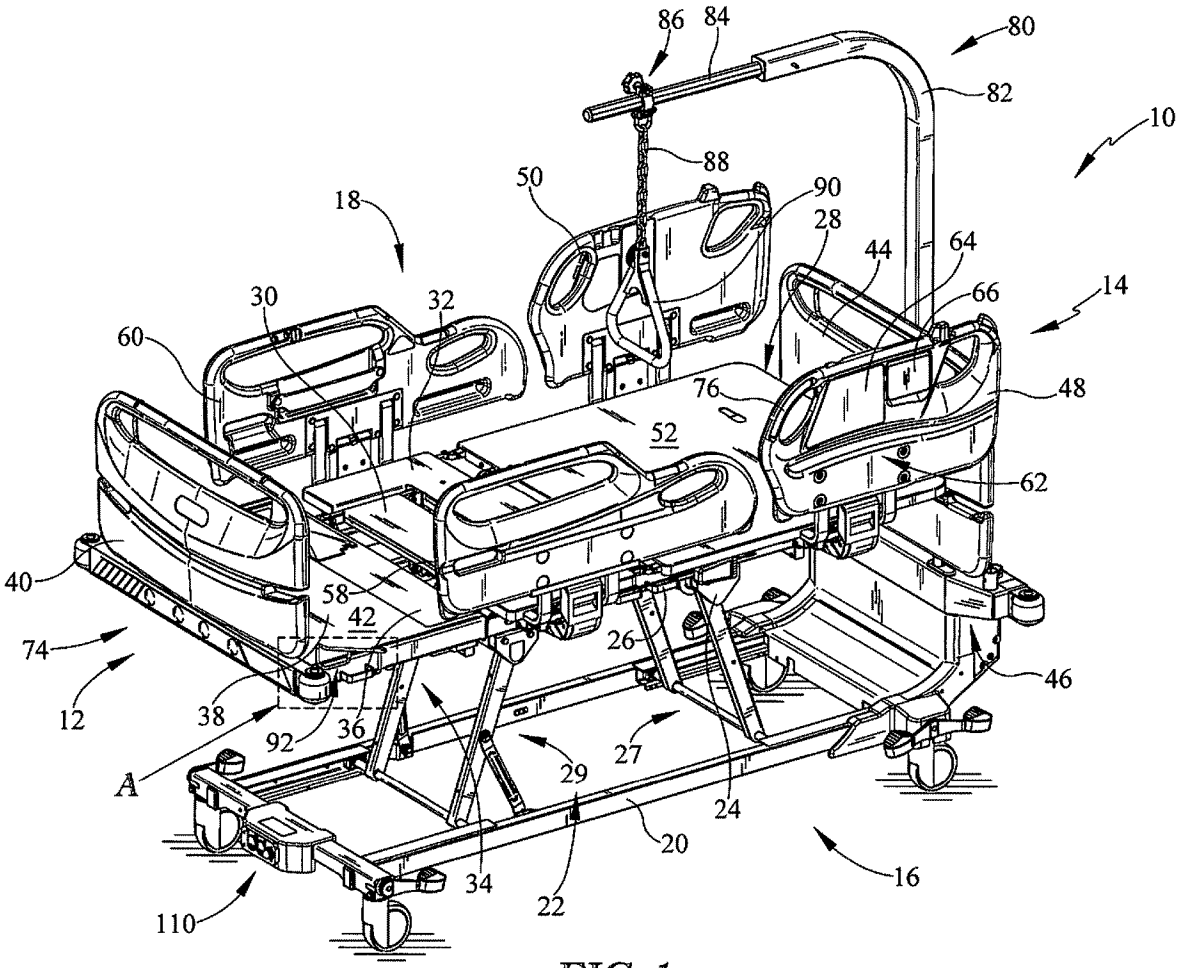
FIG. 1 is a perspective view of a patient support apparatus, illustratively embodied as a hospital bed, showing the bed having a urinary drainage support or holder adjacent a foot end of the bed as indicated by the dotted box A.

Referring to FIG. 1, a patient support apparatus 10 is illustratively embodied as a hospital bed 10. Although, the present disclosure is described in relation to a hospital bed, it will be understood that the present disclosure pertains to any support apparatus that incorporates a urinary drainage bag, sometime referred to as a Foley bag. For purposes of orientation, the discussion of the hospital bed 10 will be based on the orientation of a patient supported on the hospital bed 10 in a supine position. Thus, the foot end 12 of the hospital bed 10 refers to the end nearest the patient's feet when the patient is supported on the hospital bed 10 in the supine position. The hospital bed 10 has a head end 14 opposite the foot end 12. A left side 16 refers to the patient's left when the patient is lying in the hospital bed 10 in a supine position. The right side 18 refers to the patient's right. When reference is made to the longitudinal length of the hospital bed 10, it refers to a direction that is represented by the lines that generally extend between the head end 14 and foot end 12 of the hospital bed 10. Similarly, lateral width of the hospital bed 10 refers to a direction that is represented by the lines that generally extend between the left side 16 and right side 18 of the bed 10.

The hospital bed 10 includes a base frame 20 which supports a lift system 22. The lift system 22 supports an upper frame 24 above the base frame 20 and the lift system 22 is operable to raise, lower and tilt the upper frame 24 relative to the base frame 20. The lift system 22 includes a head end linkage 27 and a foot end linkage 29. Each of the linkages 27, 29 are independently operable and may be operated to cause the hospital bed 10 to move into a tilt position, such as a Trendelenburg position, in which the head end 14 of the upper frame 24 is positioned lower than the foot end 12 of the upper frame 24. The hospital bed 10 may also be moved to a reverse tilt position, such as a reverse Trendelenburg position, in which the foot end 12 of the upper frame 24 is positioned lower than the head end 14 of the upper frame 24.

The upper frame 24 includes a load frame 26. The load frame 26 supports a head deck section 28 which is movable relative to the load frame 26. The load frame 26 also supports an articulated thigh deck section 30, also movable relative to the load frame 26, and a fixed seat deck section 32. Also supported by the load frame 26 is a foot deck section 34 that is articulated and moveable relative to the thigh deck section 30. As will be described in further detail below, bed 10 includes actuators, such as linear actuators having electrically operated motors and extendable and retractable output shafts, that are operated to pivotably raise and lower deck sections 28, 30, 34 relative to upper frame 24. Deck sections 28, 30, 32, 34 form a mattress support deck of bed 10. In FIG. 1, the mattress supported by deck sections 28, 30, 32, 34 is omitted but the mattress is shown diagrammatically in FIG. 6 as surface 131.

In some embodiments, the foot deck section 34 includes a first portion 36 that is articulated to the thigh deck section 30, and a second portion 38 that extends and retracts relative to the first portion 36 to vary the longitudinal length of the foot deck section 34. Thus, the second portion 38 moves generally longitudinally relative to the first portion 36 to vary the longitudinal length of the foot deck 34 and, thereby, the longitudinal length of the hospital bed 10. In some embodiments, bed 10 has a motor or actuator that is operated to move the second portion 38 relative to the first portion. In other embodiments, the second portion 38 is moved manually relative to the first portion 36. In still further embodiments, the foot deck section 34 is of a fixed length such that there is no second portion 38 that is extendable and retractable with respect to first portion 36.

In the illustrative embodiment, bed 10 has a footboard 40 that is removably coupled to the foot end 12 of the second portion 38 of the foot deck section 34. Footboard 40 extends upwardly with respect to an upper surface 42 of the second portion 38 to form a barrier at the foot end 12 of the hospital bed 10. A headboard 44 is removably coupled to an upright structure 46 of the base frame 20 and extends upwardly therefrom to form a barrier at the head end 14 of the hospital bed 10. A left head siderail 48 is coupled to the head deck section 28 and is moveable between a raised position and a lowered position. A right head siderail 50 is also coupled to the head deck section and is moveable between a raised position and a lowered position. In the raised positions, the respective siderails 48, 50 extend above an upper surface 52 of the head deck section 28. In the lowered positions, an upper edge 56 of the respective siderails 48, 50 is positioned below the upper surface 52.

The hospital bed 10 also includes a left foot siderail 58 and a right foot siderail 60, each of which is supported directly from the load frame 26. Each of the siderails 48, 50, 58, and 60 are operable to be lowered to a position below the upper surface 52. It should be noted that when the head deck 28 is moved, the head siderails 48 and 50 move with the head deck 28 so that they maintain their relative position to the patient. This is because both of the head siderails 48 and 50 are supported by the head deck 28.

Figure 7:
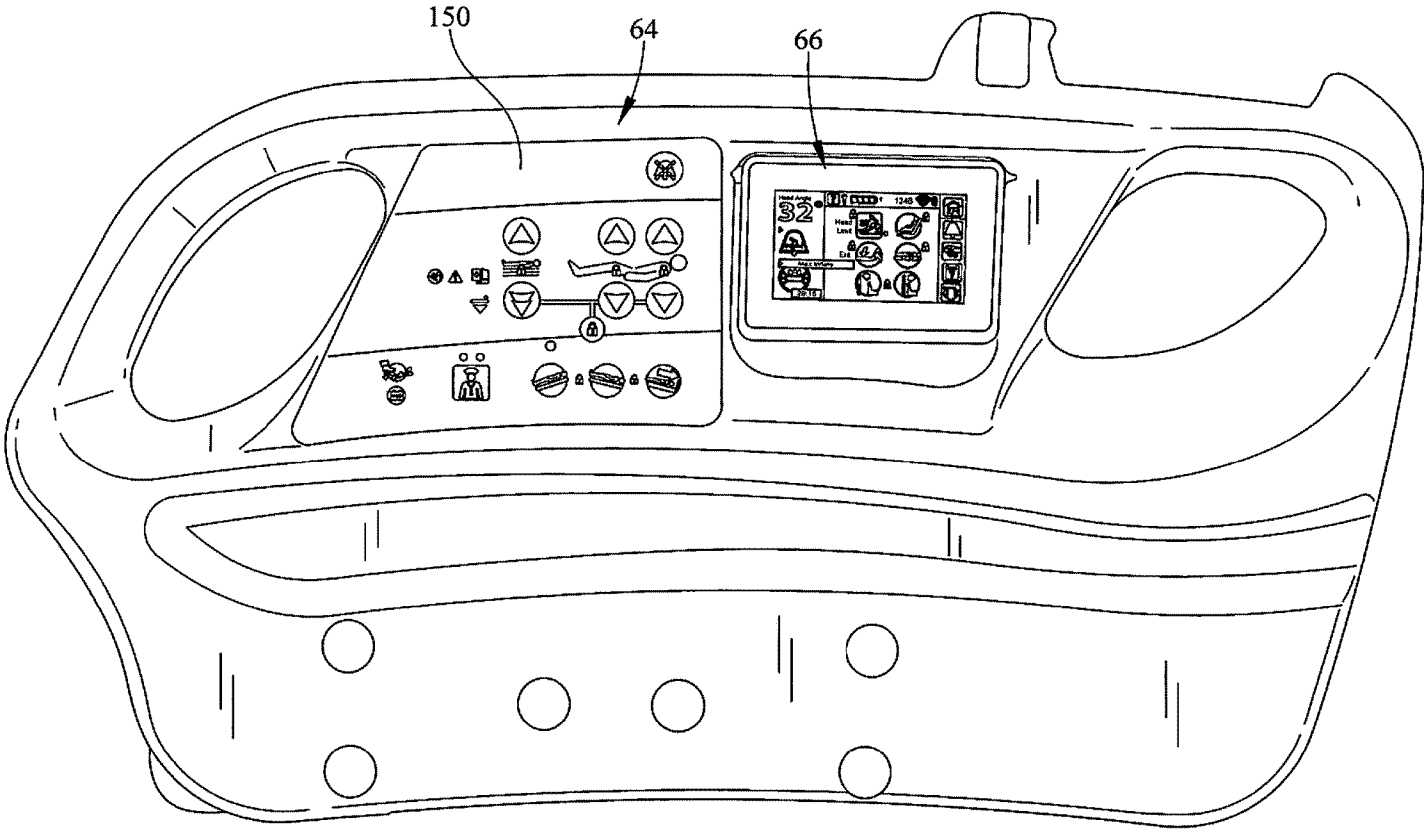
FIG. 7 is a side elevation view of a patient support apparatus siderail having a graphical user interface for controlling various bed functions including a drainage bag lockout mode.

Referring to the left head siderail 48, a user interface 62 includes a control panel 64 and a graphical user interface 66 as shown in FIG. 7. The user interface 62 will be discussed in further detail below, but it should be understood that the control panel 64 provides indications to a user regarding the status of certain functions of the hospital bed 10 as well as providing a set of fixed input devices such as hard buttons or membrane switches. The graphical user interface 66 includes a touchscreen display that provides information to a user as well as allowing for flexible, menu driven, operation of certain functions of the hospital bed 10 via the use of soft inputs such as icons or graphical buttons. The right head siderail 50 also includes a user interface 68 which includes a control panel 70. In some embodiments, the right head siderail 50 may include an optional second graphical user interface duplicative of the graphical user interface 66.

The hospital bed 10 may further include an optional patient pendant, which is used by a patient to control certain functions of the hospital bed 10. In the illustrative embodiment, additional information is provided to a caregiver through an optional indicator panel 74 which displays the status of various conditions of the hospital bed 10 graphically at the foot end 12 of the hospital bed 10. The location of the indicator panel 74 makes the statuses of the conditions easily discernable from a distance, such that a caregiver may quickly ascertain the statuses from the hallway or the door of a patient's room. Additional indication of the statuses may be projected from the bed 10 onto the floor under the foot end 12 of the hospital bed 10, thereby providing larger images on the floor that are even more easily discerned by a caregiver. Similarly, an illuminated grip 76 is positioned on the left head siderail 48 in the illustrative embodiment. The illuminated grip 76 is selectively illuminated in different colors to provide an indication of the status of one or more functions of the hospital bed 10 to a caregiver. Similarly, the right head siderail 50 also includes an illuminated grip 78, which is duplicative of the illuminated grip 76.

The hospital bed 10 includes a patient helper 80, which is removably coupled to the base frame 20. The patient helper 80 includes a curved arm 82 that is fixed to the base frame 20 and a support arm 84 that extends from the curved arm 82. The support arm 84 is formed to include a hexagonal cross-section which provides a resistance to rotation of a clamp 86 that is secured to the support arm 84. The clamp 86 supports a chain 88 which depends downwardly from the clamp 86. The chain 88 supports a grip 90 which is graspable by a patient positioned in a supine position on the hospital bed 10 so that the patient may use the patient helper 80 to reposition themselves in the hospital bed 10.

The illustrative hospital bed 10 also includes an auxiliary outlet 110 positioned at a foot end 12 of the base frame 20. The auxiliary outlet 110 provides a separate circuit, independent of the electrical system of the hospital bed 10, which may be used to power accessory equipment positioned at the foot end 12 of the hospital bed 10.

Figure 2:
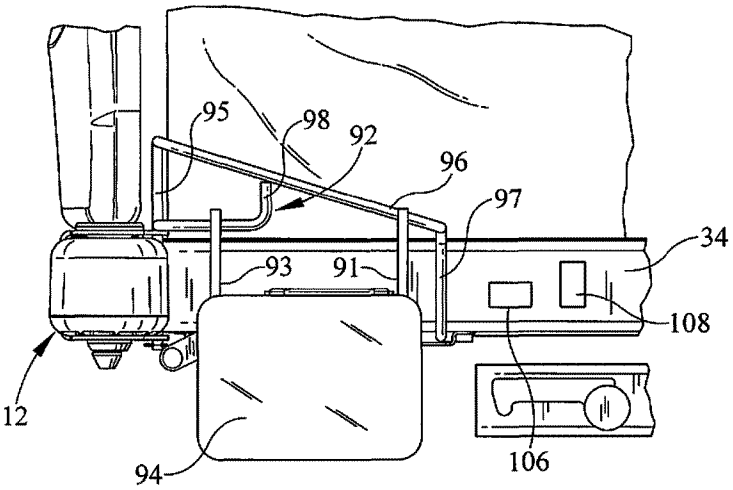
FIG. 2 is a side view of the drainage bag support expanded from Section A of FIG. 1 in a first orientation when a foot deck section to which the drainage bag support is coupled is substantially horizontal.
Figure 3:
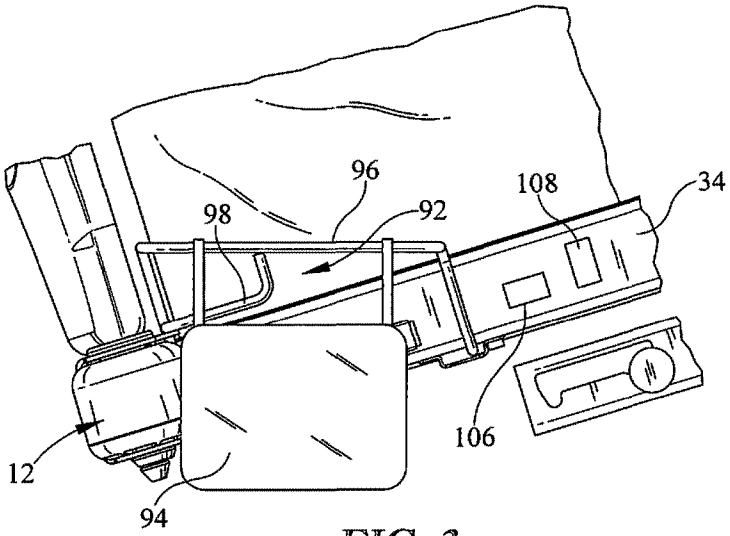
FIG. 3 is a side view of the drainage bag support expanded from Section A of FIG. 1 in a second orientation when the foot deck section is lowered.

As shown in FIGS. 1-3, bed 10 includes a drainage bag support or holder 92 coupled to a side of the foot deck section 34 adjacent to the foot end 12. FIGS. 1-3 shown the drainage bag support 92 located at the left side 16 of bed 10 but it should be appreciated that, in some embodiments, another drainage bag support 92 is coupled to foot deck section 34 at the right side of bed 10. In the illustrative embodiment, the drainage bag support 92 is coupled to the second portion 38 of the foot deck 34. A urinary drainage bag 94 is removably coupleable to the drainage bag support 92 as shown in FIGS. 2 and 3. A urinary catheter of a patient leads to drainage bag 92 such that drainage bag 92 serves as a collection receptacle for the patient's urine.

In the illustrative example, the drainage bag support 92 is a wire form structure that includes first and second upright bars 95, 97, a first rung 96, and a second rung 98. The lower ends of bars 95, 97 have extensions that extend under the bottom of foot deck section 34 and these extensions are configured for attachment, such as with fasteners like screws, bolts, rivets, etc., to the underside of foot deck section 34. Rung 96 is coupled to the upper ends of bars 95, 97. Upright bar 95 is longer than upright bar 97 such that when foot deck section 34 is oriented generally horizontally as shown in FIG. 2, rung 96 is situated at an inclined angle relative to an upper surface of foot deck section 34. Rung 98 is generally L-shaped and is situated beneath rung 96 with one end of rung 98 being coupled to rung 96 and another end coupled to upright bar 95.

When the foot deck 34 is positioned generally horizontally, first and second couplers 91, 93, such as hooks or straps, of the illustrative drainage bag 94 are typically secured to respective rungs 96, 98 as shown in FIG. 2. When the foot end 12 of the foot deck section 34 is lowered, the attachment of drainage bag 94 to holder 92 is reconfigurable such that the couplers 91, 93 of the drainage bag 94 are both attached to the first rung 96, if desired, as shown in FIG. 3. The inclined angle of rung 96 relative to the upper surface of the foot deck section 34 is such that rung 96 is generally horizontal when foot deck section 34 is lowered to its full extent relative to upper frame 24 when upper frame 24 is substantially horizontal.

In some embodiments, a button 106 is provided on a side of foot deck section adjacent to the drainage bag support 92 as shown in FIGS. 2 and 3. In such embodiments, a caregiver may press the button 106 to indicate to control circuitry 140 of bed 10, described in detail below, that the drainage bag 94 has been coupled to the drainage bag support 92. In response to button 106 being pressed, circuitry 140 is placed in a lockout mode which results in movement of certain portions of bed 10 being limited or altogether prevented. For example, upper frame 24 is locked out from lowering relative to base frame 20 when the lockout mode is activated in some embodiments. Alternatively or additionally, foot deck section 34 is locked out from lowering when circuitry 140 is in the lockout mode. In some embodiments, position thresholds or limits for the amount that upper frame 24 and/or foot deck section 34 can be lowered when circuitry 140 is in the lockout mode are established. Thus, the upper frame 24 and/or the foot deck section 34 can be lowered until the position thresholds or limits are reached in such embodiments.

Button 106 may be pressed again when the drainage bag 94 is removed from the drainage bag support 92 to deactivate or turn off the lockout mode of circuitry 140. Thus, successive presses of button 106 activates (i.e., turns on) and deactivates (i.e., turns off) the lockout mode of circuitry 140. A light 108, or other suitable indicator, is provided in the illustrative embodiment to indicate whether the lockout mode of circuitry 140 is activated or deactivated. For example, if the drainage bag 94 is positioned on the drainage bag support 92 and the button 106 is pressed, the light 108 may be illuminated to indicate that the control circuitry 140 has been notified of the presence of the drainage bag 94 and placed in the lockout mode. When the drainage bag 94 is removed from the drainage bag support 92, the button 106 may be pressed again so that the light 108 is turned off to indicate that the lockout mode is deactivated.

Figure 4:
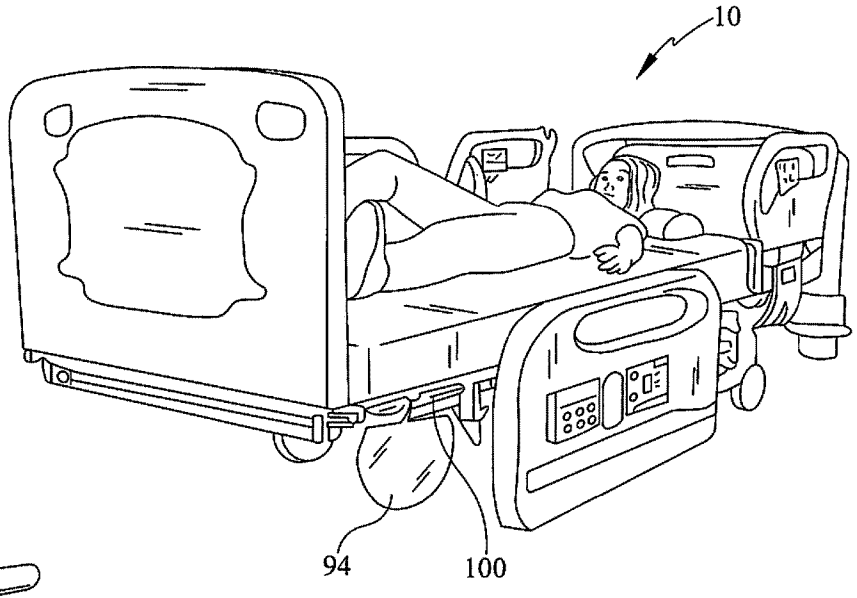
FIG. 4 is a perspective view of another embodiment of a urinary drainage bag support or holder coupled to an upper frame of a hospital bed.
Figure 5:
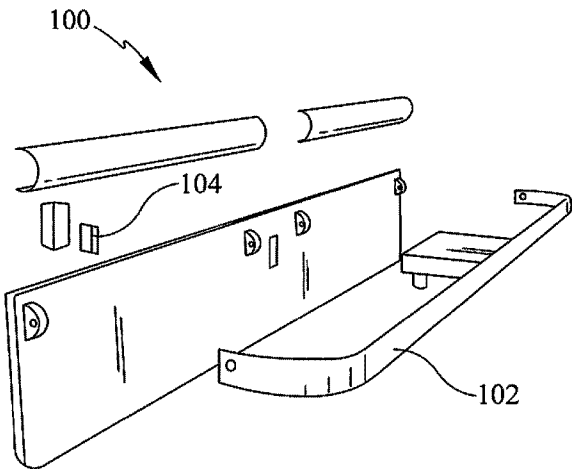
FIG. 5 is an exploded view of the drainage bag support of FIG. 4.

Referring now to FIGS. 4-5, a drainage bag support 100 is coupled to the upper frame 24 of bed 10 and includes a bar or rung 102 that interacts with a sensor 104. When the drainage bag 94 is hung on the rung 102, the sensor 104 detects the presence of the drainage bag 94. The drainage bag support 100 and sensor 104 are described in detail with respect to FIGS. 150 and 151 of U.S. Pat. No. 9,463,126, filed Mar. 6, 2015, and having the title "Caregiver Universal Remote Cart For Patient Bed Control," the contents of which are hereby incorporated herein by reference. In some embodiments, the sensor 104 is a force sensor, a proximity sensor, a piezoelectric sensor, or any other suitable sensor for detecting movement of the rung 102 and/or presence of the drainage bag 94 on the rung 102. It should be noted that the embodiment of FIGS. 4-5 may also include the light 108 shown in FIGS. 2-3.

Figure 6:
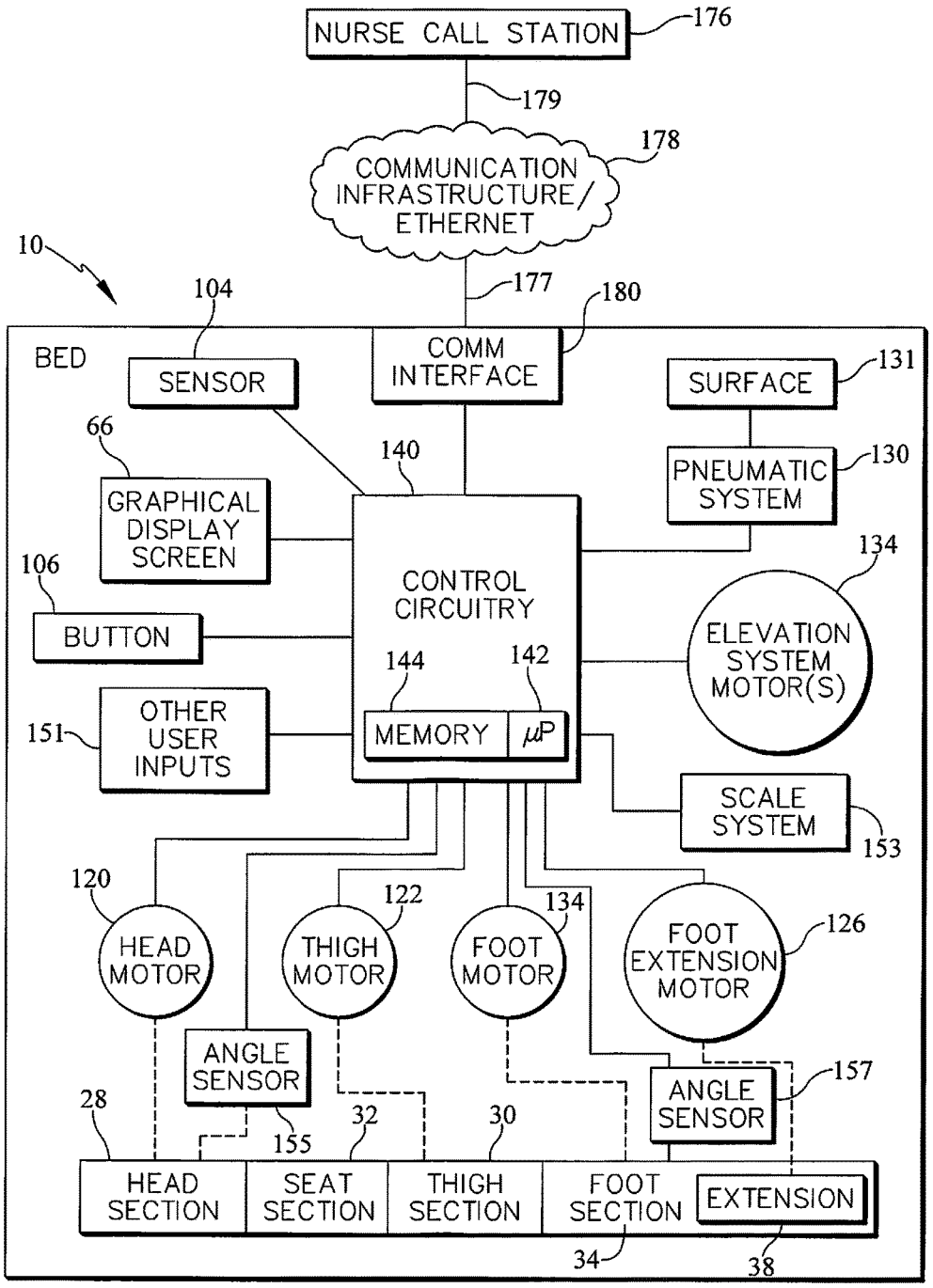
FIG. 6 is a block diagram showing electrical circuitry of the hospital bed of FIG. 1 in communication with a nurse call station or computer.

As shown diagrammatically in FIG. 6, bed 10 includes a head motor or actuator 120 coupled to head deck section 28, a thigh motor or actuator 122 coupled to articulated thigh deck section 30, a foot motor or actuator 124 coupled to foot deck section 34, and a foot extension motor or actuator 126 coupled to the second portion 38 of foot deck section 34. Motors 120, 122, 124, 126 may include, for example, an electric motor of a linear actuator. Head motor 120 is operable to raise and lower head deck section 28, thigh motor 122 is operable to articulate thigh deck section 30 relative to head seat deck section 32, foot motor 124 is operable to raise and lower foot deck section 34 relative to thigh deck section 30, and foot extension motor 126 is operable to extend and retract the second portion 38 of the foot deck section 34 relative to the first portion 36 of the foot deck section 34. In some embodiments, foot deck extension motor 126 is omitted from the bed 10. In such embodiments, the second portion 38 of the foot deck 34 may be manually extended and retracted with respect to the first portion 36 of the foot deck 34. Alternatively, the foot deck section 34 may not include a second portion 38 that is moveable with respect to a first portion 36 such that the foot deck section does not extend and retract.

Illustrative bed 10 also includes a head angle sensor 155 coupled to the head deck section 28 to monitor an angle of the head deck section 28 with respect to the upper frame 24. Illustrative bed 10 also includes a foot angle sensor 157 coupled to the foot deck section 34 to monitor an angle of the foot deck 34 with respect to the upper frame 24. In some embodiments, the foot angle sensor 157 determines whether the foot deck 34 is positioned below a predetermined angle, as described in more detail below. Either or both of angle sensors 155, 157 are gravity based sensors such as accelerometers or inclinometers in some embodiments. In other embodiments, either or both of angle sensors 155, 157 are included in the linear actuators associated with head motor 120, in the case of angle sensor 155, and foot motor 124, in the case of angle sensor 157. In such embodiments, angle sensors 155, 157 may comprise, for example, rotary shaft encoders, Hall effect sensors, rotary potentiometers, and the like.

In some embodiments, bed 10 includes a pneumatic system 130 that controls inflation and deflation of various air bladders or cells of a mattress or surface 131. The pneumatic system 130 is represented in FIG. 2 as a single block but that block 130 is intended to represent one or more air sources (e.g., a fan, a blower, a compressor) and associated valves, manifolds, air passages, air lines or tubes, pressure sensors, and the like, as well as the associated electric circuitry, that are typically included in a pneumatic system for inflating and deflating air bladders of mattresses. A scale system 153 may be provided to monitor a weight of a patient on the mattress 131.

A lift system of bed 10 includes one or more elevation system motors or actuators 134, which in some embodiments, include linear actuators with electric motors. Thus, actuators 134 are sometimes referred to herein as motors 134. Alternative actuators or motors contemplated by this disclosure include hydraulic cylinders and pneumatic cylinders, for example. The motors 134 of lift system are operable to raise, lower, and tilt upper frame 24 relative to the base frame 20. In the illustrative embodiment, one of motors 134 is coupled to, and acts upon, head end linkage 27 and another of motors 134 is coupled to, and acts upon, a foot end linkage 29 to accomplish the raising, lowering and tilting functions of upper frame 24 relative to base frame 20. Motors 134 include sensors in some embodiments which are used to determine the amount of elevation and tilt of upper frame 24 relative to base frame 20, relative to horizontal, or relative to vertical.

As shown diagrammatically in FIG. 6, bed 10 includes control circuitry 140 that is electrically coupled to motors 120, 122, 124, 126 and to motors 134 of lift system. Control circuitry 140 is represented diagrammatically as a single block 140 in FIG. 2, but control circuitry 140 in some embodiments comprises various circuit boards, electronics modules, and the like that are electrically and communicatively interconnected. Control circuitry 140 includes one or more microprocessors 142 or microcontrollers that execute software to perform the various control functions and algorithms described herein. Thus, circuitry 140 also includes memory 144 for storing software, variables, calculated values, and the like as is well known in the art.

As also shown diagrammatically in FIG. 6, a user inputs block 151 represents the various user inputs such as buttons of control panels 66 which in the illustrative embodiment of FIG. 7, comprises a membrane switch assembly 150 having membrane switches that are used by the caregiver or patient to communicate input signals to control circuitry 140 of bed 10 to command the operation of the various motors 120, 122, 124, 126, 134 of bed 10, as well as commanding the operation of other functions of bed 10. Bed 10 includes at least one graphical user input or display screen 66 coupled to a respective siderail 48 as shown in FIGS. 1 and 7. Display screen 66 is coupled to control circuitry 140 as shown diagrammatically in FIG. 6. In some embodiments, two graphical user interfaces 66 are provided and are coupled to respective siderails 48, 50. Alternatively or additionally, one or more graphical user interfaces are coupled to siderails 48, 50 and/or to one or both of the headboard 44 and footboard 40. Control circuitry 140 receives user input commands from graphical display screen 66. In some embodiments, control circuitry 140 may receive signals from sensor 104 and/or button 106.

According to this disclosure, control circuitry 140 of bed 10 is able to communicate with a remote computer device 176 via communication infrastructure 178 such as an Ethernet of a healthcare facility in which bed 10 is located and via communications links 177, 179, as shown diagrammatically in FIG. 6. Computer device 176 is sometimes simply referred to as a "computer" herein. Remote computer 176 may comprise a nursing station or be part of a nurse call system according to this disclosure. In some embodiments, remote computer 176 may be part of an electronic medical records (EMR) system. It is within the scope of this disclosure for circuitry 140 of bed 10 to communicate with other computers such as those included as part of a physician ordering system, an admission/discharge/transfer (ADT) system, or some other system used in a healthcare facility in other embodiments. Ethernet 178 in FIG. 6 is illustrated diagrammatically and is intended to represent all of the hardware and software that comprises a network of a healthcare facility.

In the illustrative embodiment, bed 10 has a communication interface or port 180 which provides bidirectional communication via link 179 with infrastructure 178 which, in turn, communicates bidirectionally with computer 176 via link 177. Link 179 is a wired communication link in some embodiments and is a wireless communications link in other embodiments. Thus, communications link 179, in some embodiments, comprises a cable that connects bed 10 to a wall mounted jack that is included as part of a bed interface unit (BIU) or a network interface unit (NIU) of the type shown and described in U.S. Pat. Nos. 7,538,659 and 7,319,386 and in U.S. Patent Application Publication Nos. 2009/0217080 A1, 2009/0212925 A1 and 2009/0212926 A1, each of which is hereby expressly incorporated by reference herein. In other embodiments, communications link 179 comprises wireless signals sent between bed 10 and a wireless interface unit of the type shown and described in U.S. Patent Application Publication No. 2007/0210917 A1 which is hereby expressly incorporated by reference herein. Communications link 177 comprises one or more wired links and/or wireless links as well according to this disclosure.

Figure 8:
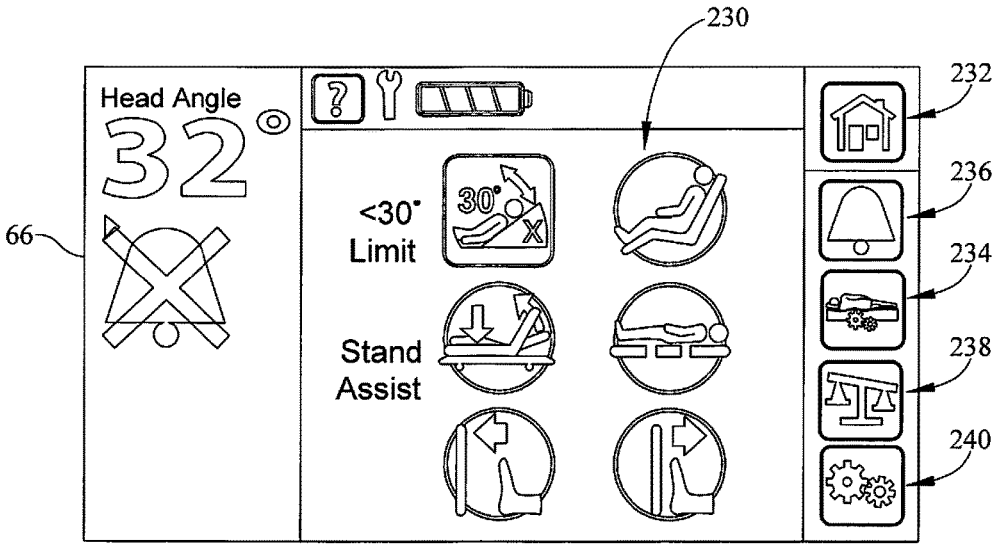
FIG. 8 is a screenshot of a graphical user interface home screen having a settings/preferences button in the lower right hand corner of the screen.

Referring to FIG. 7, in one embodiment the control panel 64 includes the membrane switch assembly 150 and the graphical user interface 66 to provide access to a number of standard functions of the hospital bed 10 for a caregiver. The interface 66 is shown to have a number of iconic symbols which provide information to the caregiver and operate as soft keys for the caregiver to activate functions of the hospital bed 10. A high-level menu structure for the graphical user interface 66 is shown in FIG. 8. Bed movement soft keys 230 enable the caregiver or patient to control movement of the patient support apparatus. Under normal operating conditions, the graphical user interface 66 will display a home screen that may be subject to a five-minute timeout, for example, which results in the home screen being replaced by a sleep screen.

Figure 9:
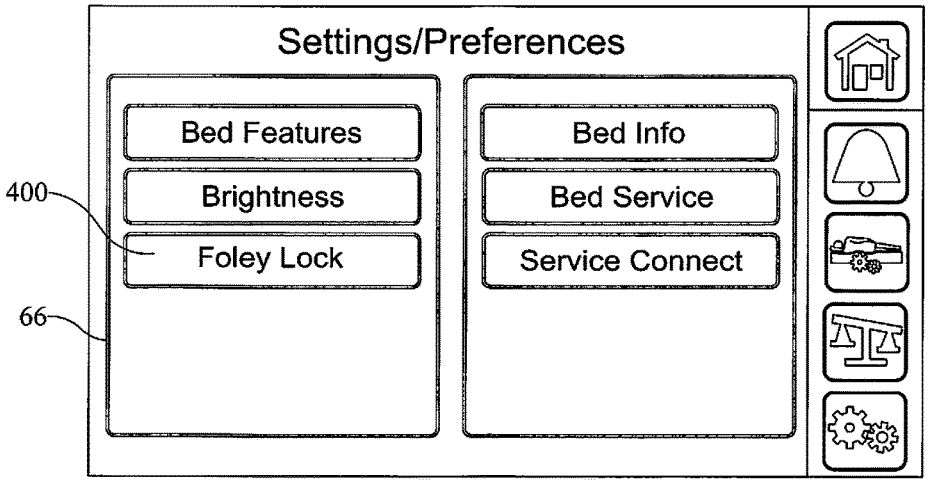
FIG. 9 is a screenshot of a graphical user interface settings/preferences screen having a Foley Lock button on the left hand side of the screen.

A home screen soft key 232 enables the user to return to the home screen at any time. The menu driven controls include a surface control soft key 234 which allows a user to interact with the controls of the mattress 131 positioned on the patient support apparatus 10. An alert soft key 236 allows the user to interface with patient position monitoring functionality or chair exiting functionality of bed 10. A scale soft key 238 allows a caregiver to access the operation of the scale system 153 to utilize a zeroing function including the ability to zero the hospital bed 10 for a new patient. In addition, the scale soft key 238 allows a user to access a weighing menu structure. A settings soft key 240 allows the caregiver to alter the settings of the patient support apparatus 10 in a settings structure illustrated in FIG. 9.

In some embodiments, the membrane switch assembly 150 and/or the bed movement soft keys 230 of the interface 66 allow the user to lower the patient support apparatus 10 or a portion thereof, for example, the foot deck section 34 or upper frame 24. In some embodiments, the foot deck section 34 may be lowered at an angle so that the foot end 12 of the patient support apparatus is lowered. Lowering of the patient support apparatus 10 or a portion thereof allows the patient to be positioned in a sitting position and/or allows the patient to exit the patient support apparatus 10 from the foot end 12 in some embodiments. When the drainage bag 94 is coupled to the drainage bag holder 90 near the foot end 12 of the patient support apparatus 10, the drainage bag 94 may move into an unwanted position in which the drainage bag 94 is in contact with the floor, for example, thereby potentially contaminating the drainage bag 94 and creating the possibility of the patient contracting a catheter-associated urinary tract infection (CAUTI). In some embodiments, the control circuitry 140 may activate a Foley Lock or lockout mode to prevent movement of the patient support apparatus 10 or the upper frame 24 and/or the foot deck 34 entirely and/or within predetermined ranges.

Figure 19:
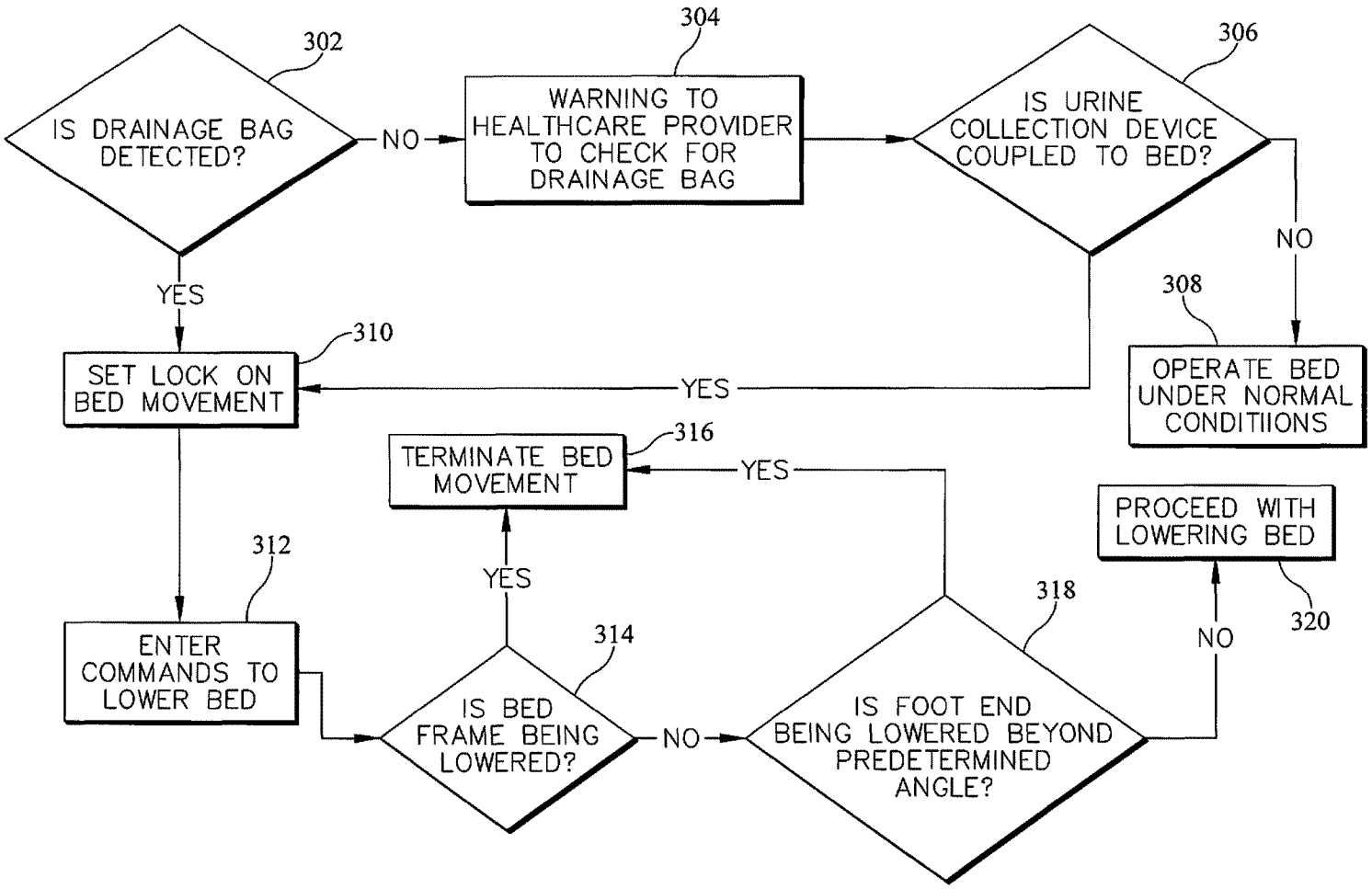
FIG. 19 is a flowchart of a method for operating a patient support apparatus, such as those of FIGS. 1 and 4, having a lockout mode that prohibits certain frame movements of the patient support apparatus when the lockout mode is activated.

Referring to FIG. 19, at step 302, a determination is made whether a drainage bag 94 is detected. In some embodiments, the drainage bag 94 is detected manually by a caregiver, i.e. the caregiver positions the drainage bag 94 on the drainage bag support 92, and so the caregiver has knowledge that the drainage bag 94 is attached to the bed 10. In some embodiments, the caregiver may press the button 106 to indicate to the control circuitry 140 that the drainage bag 94 has been positioned on the drainage bag support 92. Upon pressing the button 106 to activate the lockout mode, the light 108 may be activated as a visual indicator that the control circuitry 140 is notified of the drainage bag 94. In some embodiments, the sensor 104 detects the drainage bag 94 and sends a signal to the control circuitry 140 to activate the lockout mode. In such an embodiment, a light or other suitable indicator may be illuminated as discussed above. In some embodiments, the control circuitry 140 may automatically place the bed 10 in the lockout mode based on patient information received from the remote computer 176 or entered on interface 66 indicating that a specific patient requires a drainage bag 94.

If a drainage bag 94 is not detected, at step 304, the interface 66 may warn the caregiver to check for a drainage bag. In such a scenario, the caregiver may manually check for the presence of the drainage bag 94 at step 306. Upon verifying the presence of the drainage bag 94, the caregiver may actuate the button 106 and/or the interface 66 to verify the presence of the drainage bag 94. In an embodiment where a drainage bag 94 is not detected, the caregiver may check the patient chart to verify whether a drainage bag 94 is required and/or proceed with operating the bed 10 as normal at step 308.

If a drainage bag 94 is detected and/or verified by the caregiver, the control circuitry 140 sets or activates the lockout mode on the bed at step 310. In some embodiments, in the lockout mode, the control circuitry is programmed to prevent or limit operation of the bed movement functions as discussed above. Alternatively or additionally, in the lockout mode, a mechanical lock may physically prevent or limit movement of portions of the bed 10. The lockout mode may prevent or limit movement of the upper frame 24 relative to the base frame 20. In some embodiments, the lockout mode prevents lowering of the upper frame 24. In some embodiments, the lockout mode prevents lowering of the upper frame 24, but enables the upper frame 24 to be raised. In some embodiments, the lockout mode prevents tilting of the upper frame 24 to place the foot end 12 of upper frame 24 lower in elevation than the head end 14 of upper frame, e.g., movement to or toward the reverse Trendelenburg position.

The lockout mode may also prevent movement of the foot deck section 34, i.e. movement of the foot end 12 of foot deck section 34. In some embodiments, the lockout mode prohibits lowering the foot deck section 34 beyond a predetermined angle with respect to the upper frame 24. In some embodiments, the lockout mode enables raising of the foot deck section 34, while prohibiting lowering of the foot deck section 34. In some embodiments, the lockout mode enables the foot deck section 34 to be lowered downwardly to the predetermined angle, but prohibits movement of the foot deck section 34 below the predetermined angle. In some embodiments, the predetermined angle is defined as about 12 degrees between the foot deck section 34 and the upper frame 24.

Figure 17:
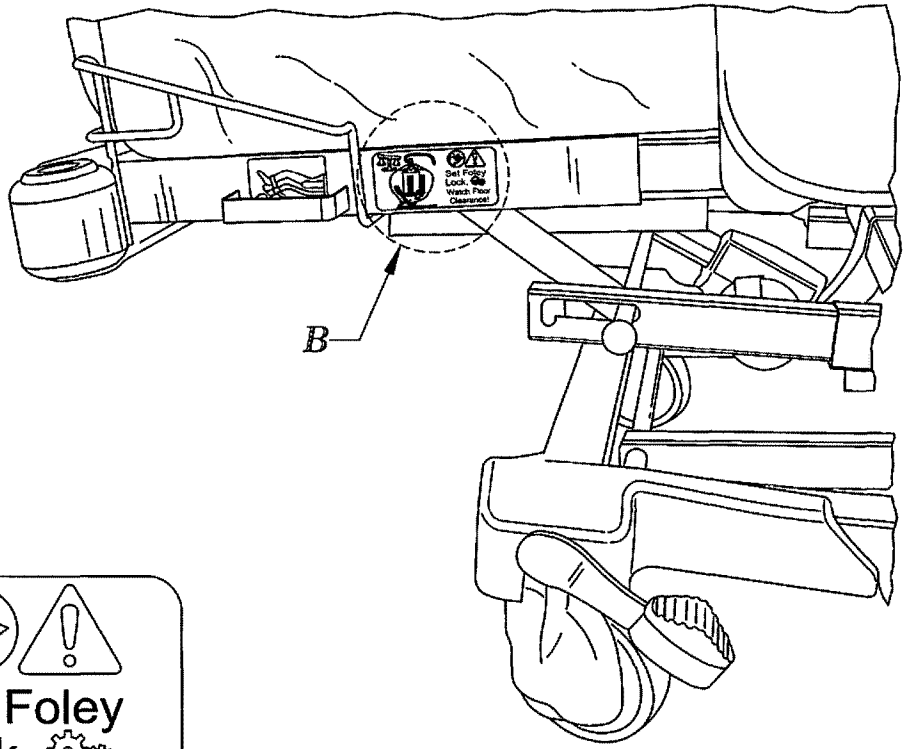
FIG. 17 is a perspective view of a foot end of the patient support apparatus of FIG. 1 showing a warning label, as indicated by the dotted oval B, adjacent to the drainage bag support to remind a user to activate the lockout mode when a drainage bag is coupled to the drainage bag support.
Figure 18:
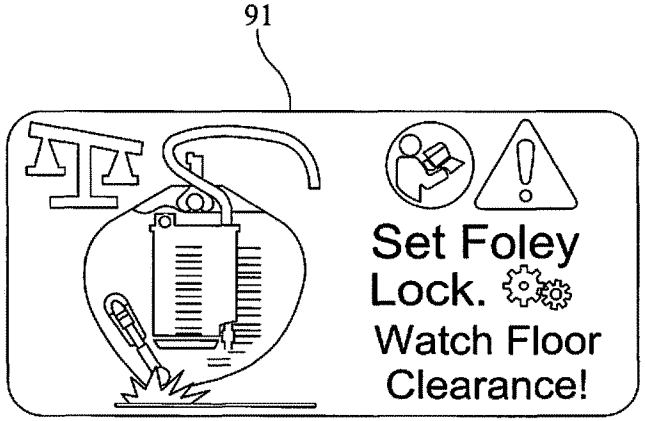
FIG. 18 is a side elevation view of the warning label expanded from Section B of FIG. 17.

Activation of the lockout mode may occur in multiple ways. For example, the caregiver may manually set the lockout mode, as described in more detail below. In some embodiments, the caregiver may be reminded to set the lockout mode via warnings on the interface 66 and/or warnings 91 provided at the drainage bag support 92, as shown in FIGS. 17 and 18. In some embodiments, when the sensor 104 detects the presence of the drainage bag 94 on the drainage bag support 92, the sensor 104 notifies the control circuitry 140 to activate the lockout mode. In some embodiments, when the button 106 is activated by a caregiver, the button 106 sends a signal to the control circuitry 140 to activate the lockout mode.

Figure 10:
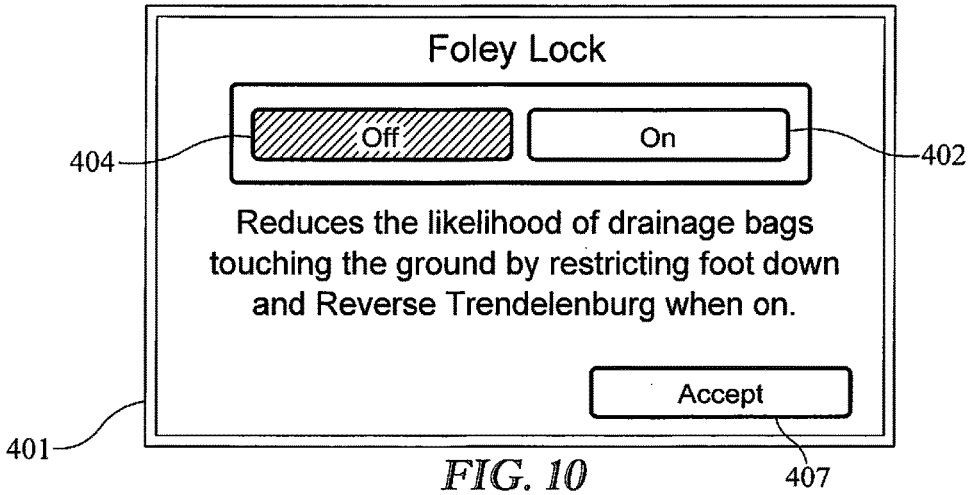
FIG. 10 is a screenshot of a graphical user interface showing a Foley Lock screen having an Off button highlighted to indicate that the drainage bag lockout mode is to be deactivated in response to selection of an Accept button.
Figure 11:
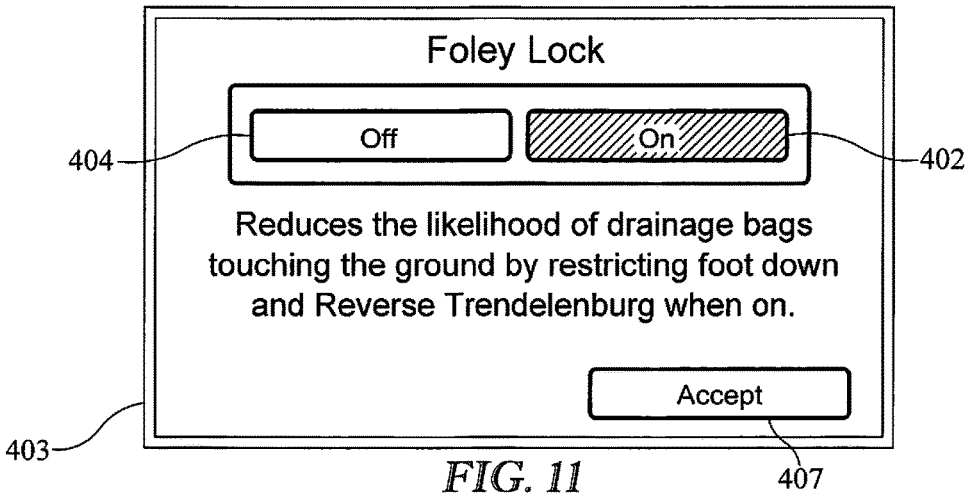
FIG. 11 is another screenshot of a graphical user interface Foley Lock screen, similar to FIG. 10, but having an On button highlighted to indicate that the drainage bag lockout mode is to be activated in response to selection of the Accept button.
Figure 12:
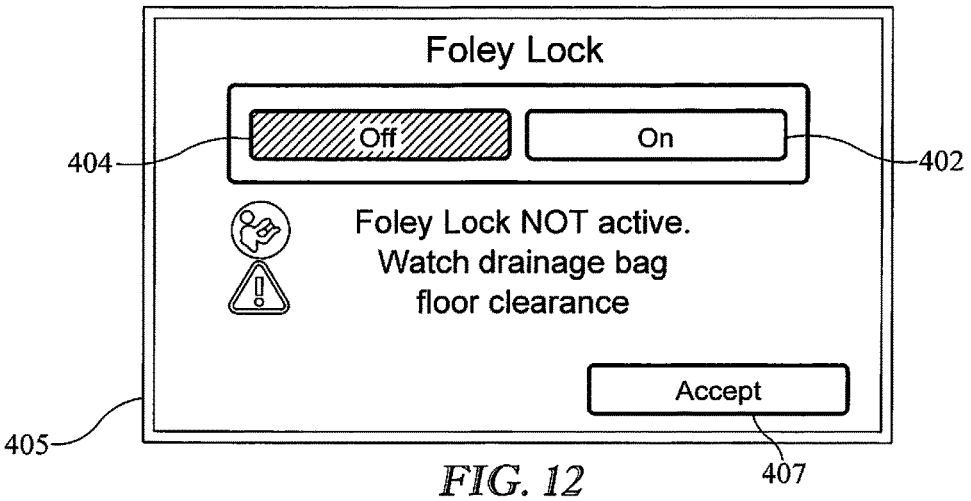
FIG. 12 is yet another screenshot of a graphical user interface Foley Lock screen, similar to FIGS. 10 and 11, showing a warning message that appears on the graphical user interface in response to portions of a bed frame being lowered and showing the Off button highlighted to indicate that the drainage back lockout mode is deactivated.

When manually activating the lockout mode, the caregiver may use the interface 66 by selecting the settings soft key 240 of the high-level menu structure of the graphical user interface 66 shown in FIG. 8. In response to selection of soft button 240, the settings screen of FIG. 9 appears on interface 66. The settings screen of FIG. 9 includes a settings menu that includes various soft keys for adjusting the settings of the bed 10. A Foley Lock soft key 400 is selected to reach a Foley lock screen, shown in FIGS. 10 and 11, which permit the user to manually activate and deactivate the lockout mode at the user's discretion. FIGS. 10 and 11 show examples of the Foley Lock screens 401, 403. Each of screens 401, 403 include an On soft key 402, an Off soft key 404, and an Accept key 407. Selecting the On soft key 402 and then selecting the Accept key 407 manually activates the lockout mode to prevent the drainage bag 94 from moving to the unwanted position in contact with the floor. Conversely, selecting the Off soft key 404 and then selecting the Accept key 407 deactivates the lockout mode so that the bed can be moved according to normal operations. If the lockout mode is deactivated and the user attempts to lower the upper frame 24 of bed 10 and/or to lower the foot deck section 34 of bed 10, a warning screen 405, shown in FIG. 12, appears on interface 66 to provide a warning to the caregiver advising that the lockout mode is not activated. In the illustrative example, the warning screen 405 includes the keys 402, 404, 405 so that the user can activate the lockout mode, if desired.

Figure 13:
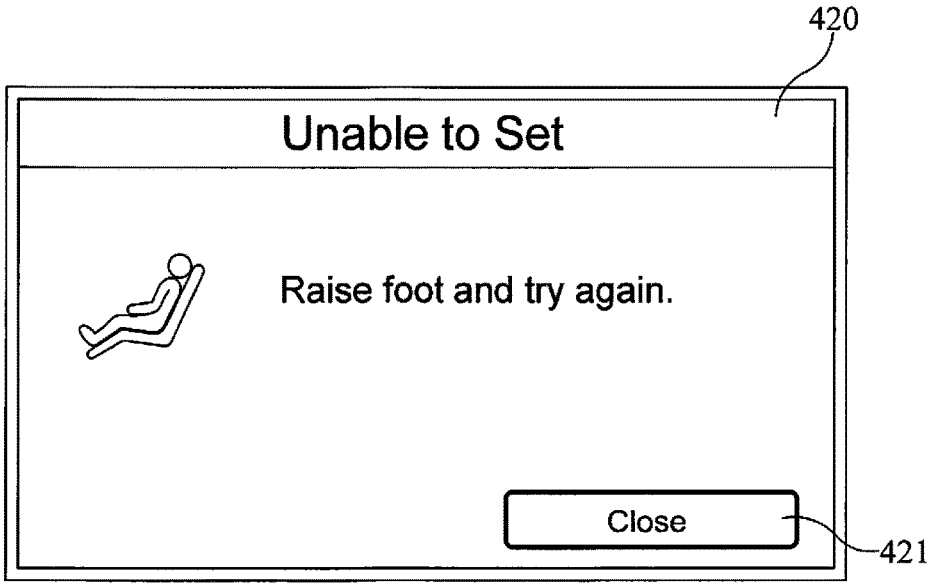
FIG. 13 is a screenshot of a graphical user interface warning screen indicating that the foot deck of the bed should be raised before the drainage back lockout mode can be activated.

Referring now to FIG. 13, a warning screen 420 is displayed on the interface 66 if the caregiver attempts to activate the lockout mode when the foot deck section 34 is positioned below the predetermined angle, i.e. the foot deck 34 is outside of an acceptable range for use of the lockout mode. Warning screen 420 instructs the caregiver to raise the foot deck section 34 to an appropriate angle, i.e. elevated above the predetermined angle, prior to setting the lockout mode. It should be noted that the warning screen 420 may also serve as a reminder to the caregiver that any drainage bag 94 positioned on the bed 10 may already be in contact with the floor. In some embodiments, the caregiver may set the lockout mode prior to positioning the drainage bag 94 on the drainage bag support 92. The warning screen 420 ensures that the foot deck 34 is appropriately positioned so that the drainage bag 94 will not contact the floor.

Figure 14:
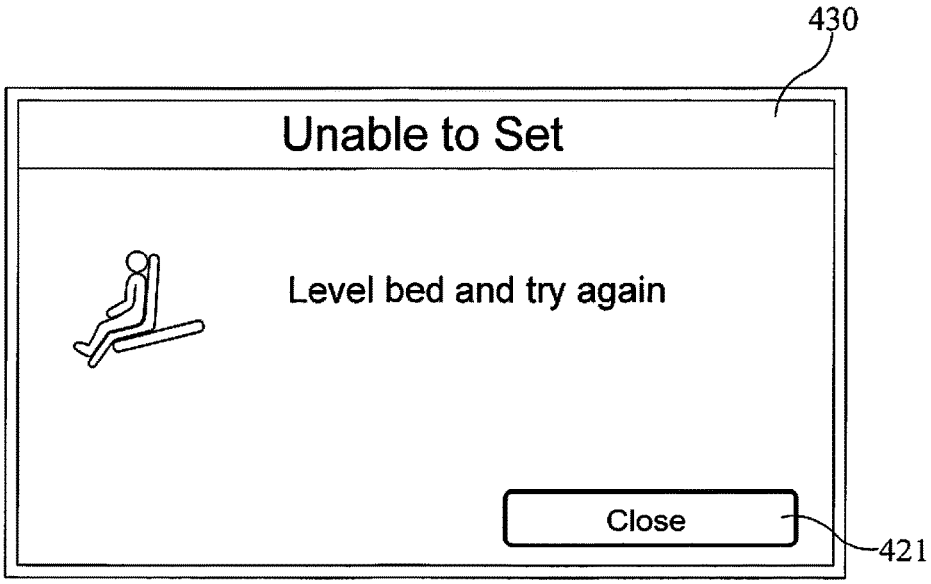
FIG. 14 is a screenshot of another graphical user interface warning screen indicating that the upper frame of the bed should be leveled before the drainage bag lockout mode can be activated.

Referring to FIG. 14, a warning screen 430 is displayed on the interface 66 if the caregiver attempts to activate the lockout mode when the upper frame 24 is in a lowered position or an un-level position. Warning screen 430 instructs the caregiver to level and raise the upper frame 24 prior to activating the lockout mode. It should be noted that the warning screen 430 may also serve as a reminder to the caregiver that any drainage bag 94 positioned on the bed 10 may already be in contact with the floor. In some embodiments, the caregiver may set the lockout mode prior to positioning the drainage bag 94 on the drainage bag support 92. The warning screen 430 ensures that the upper frame 24 is appropriately positioned so that the drainage bag 94 will not contact the floor.

In some instances, the caregiver may receive both warning screens 420, 430 on interface 66 if the conditions for receiving such screens 420, 430 are satisfied. In those instances in which the bed 10 is already appropriately positioned for activating the lockout mode, the caregiver will not receive either of warning screen 420, 430. In some embodiments, the status of the bed 10 is transmitted to the computer device 176, wherein the bed status may be monitored and recorded. For example, the computer device 176 may be notified of any warning screens 420, 430 received during set up of the bed 10. The computer device 176 may also be notified of the status of the lockout mode, i.e. whether the lockout mode is activated or deactivated and the times during which activation and deactivation exist. Accordingly, caregivers or other personal at the computer device 176 may monitor the status of the bed 10. In some embodiments, the warnings screens 420, 430 may be closed by selecting a soft key 421.

Referring once again to FIG. 19, at step 312 a caregiver may enter commands to move the bed 10 or a portion thereof. If the lockout mode is set, at step 314 the control circuitry 140 determines whether the commands instruct the control circuitry 140 to move the upper frame 24 in violation of the upper frame movement limits defined by the lockout mode and discussed above. If the upper frame movement violates the restrictions on movement of the upper frame 24, the control circuitry will terminate movement of the bed 10 at step 316. If the movement of the bed does not violate the restrictions on movement of the upper frame 24, the control circuitry 140 determines, at step 318, whether the movement of the bed 10 violates the restrictions on movement of the foot deck section 34. If the movement of the bed 10 does violate the restrictions on movement of the foot deck section 34, the control circuitry 140 terminates the bed movement at step 316.

If the movement of the bed 10 does not violate the restrictions on the movement of the foot deck section 34, the control circuitry, at step 320, enables movement of the bed 10. It should be noted that the steps 314, 318 may be taken in any order or concurrently. Moreover, when the lockout mode is set, the control circuitry may restrict movement of one of the foot deck 34 and the upper frame 24, while enabling movement of the other of the foot deck 34 and the upper frame 24 in some embodiments. For example, the control circuitry 140 may enable the foot deck section 34 to be moved, while prohibiting movement of the upper frame 24. Likewise, the control circuitry 140 may enable movement of the upper frame 24, while prohibiting movement of the foot deck section 34.

Figure 15:
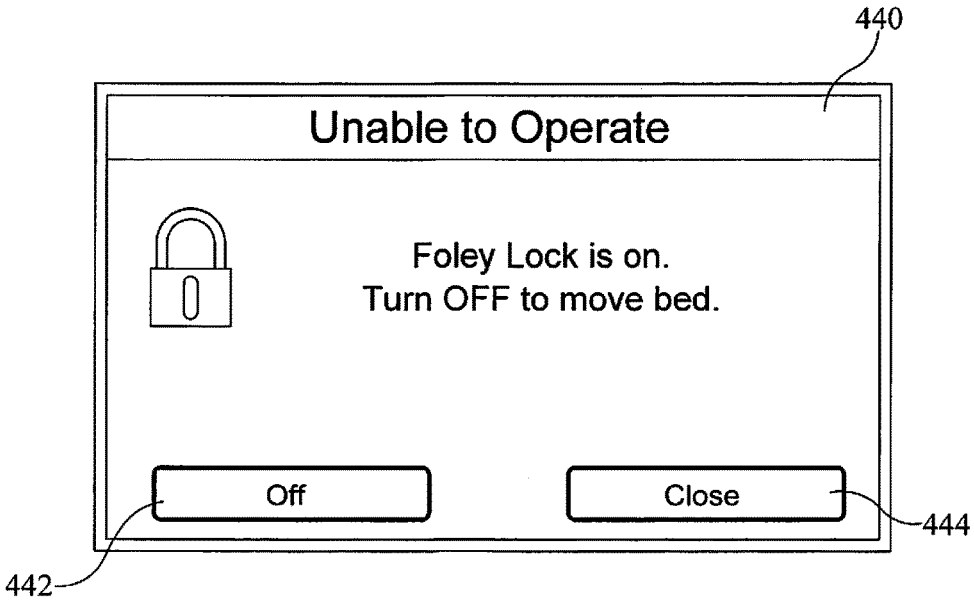
FIG. 15 is a screenshot of a further graphical user interface warning screen that appears when a user attempts to move a portion of the bed that is locked out from moving when the drainage bag lockout mode is activated.

Upon entering commands to move the bed 10 at step 312, the caregiver may receive a warning regarding the status of the lockout mode. Referring to FIG. 15, if the lockout mode is active, a warning screen 440 may appear on the interface 66 indicating the movement of the bed 10 is either restricted or limited. After receiving the warning screen 440, the caregiver may remove the drainage bag 94 and select an Off soft key 442 to turn off the lockout mode. In some embodiments, the caregiver may select a Close soft key 444 to close the warning screen 440. The caregiver may choose not to move the bed 10 given that the lockout mode is set. Alternatively, the caregiver may choose to move the bed 10 within the parameters provided by the lockout mode. For example, the bed 10 may still be moved without lowering the upper frame 24 and/or without lowering the foot deck section 34 below the predetermined angle.

Figure 16:
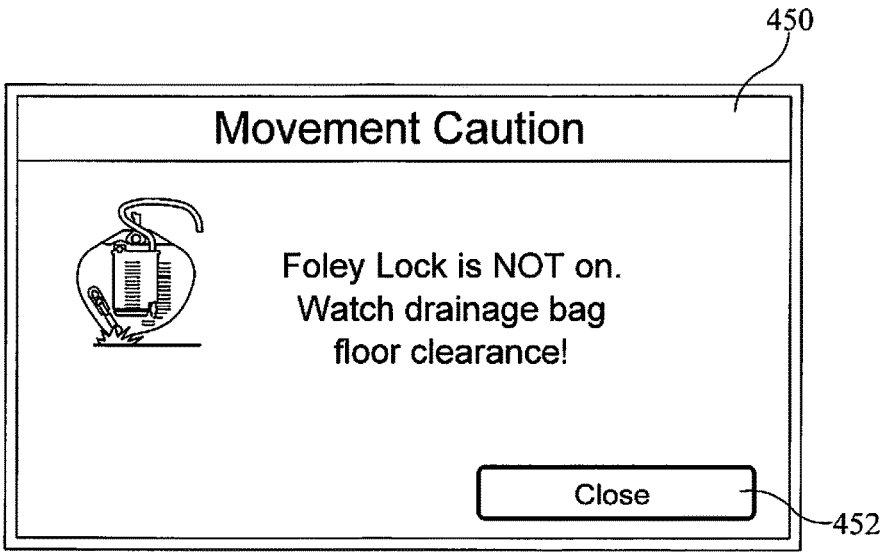
FIG. 16 is a screenshot of another graphical user interface warning screen indicating that the Foley Lock is not activated.

Referring to FIG. 16, if the lockout mode is not active, a warning screen 450 may appear on the interface 66 indicating that the lockout mode is not active. The caregiver may close the warning by selecting a Close soft key 452. Upon receiving the warning screen 450, the caregiver may check for the presence of a drainage bag 94. If a drainage bag 94 is not present, the caregiver may continue to operate the bed 10 as planned. If a drainage bag 94 is present, the caregiver may remove the drainage bag 94 before operating the bed 10 or set the lockout mode using the interface 66 or other described methods of setting the lockout mode. In some embodiments, the user may then operate the bed 10 within the constraints of the lockout mode.

It should be noted that the operation of the bed 10, the use of the lockout mode, changes to the activation status of the lockout mode, use of the interface 66 and use of other associated components of bed 10 are reported to the computer device 176 by bed 10 in some embodiments, so that the operation of the bed 10 may be monitored at the computer device 176 and/or so that data regarding the operation of bed 10 may be stored in memory of the computer device 176.

Although this disclosure refers to specific embodiments, it will be understood by those skilled in the art that various changes in form and detail may be made without departing from the subject matter set forth in the accompanying claims.

The invention claimed is:

1. A patient support apparatus comprising:

a frame having a first portion and a second portion, the first portion being pivotally movable to raise and lower relative to the second portion;

a drainage bag support coupled to the first portion of the frame to move therewith, the drainage bag support having a first rung that is substantially horizontal to a floor when the first portion is raised and a second rung that is angled with respect to the first rung and is substantially horizontal to the floor when the first portion is lowered;

control circuitry to control movement of the first portion of the frame, wherein the control circuitry has a lockout mode to prevent movement of the first portion of the frame relative to the second portion of the frame, and an indicia positioned adjacent the drainage bag support notifying a caregiver to activate the lockout mode in response to a drainage bag being coupled to the first rung of the drainage bag support so that the first portion is unable to be moved to place the drainage bag in an unwanted position.

2. The patient support apparatus of claim 1, wherein the frame comprises a mattress support deck including a foot deck section and wherein the foot deck section comprises the first portion of the frame.

3. The patient support apparatus of claim 2, wherein the control circuitry, when operating in the lockout mode, prevents lowering of the foot deck section if the foot deck section is positioned at an angle greater than a predetermined angle with respect to the second portion of the frame.

4. The patient support apparatus of claim 3, wherein the control circuitry, when operating in the lockout mode, allows lowering of the foot deck section if the foot deck section is positioned at an angle less than the predetermined angle and prevents lowering of the foot deck section when the predetermined angle is met.

5. The patient support apparatus of claim 2, wherein the foot deck section include a first foot deck section portion and a second foot deck section portion that is extendable and retractable relative to the first foot deck section portion and wherein the drainage bag support is coupled to the second foot deck section portion.

6. The patient support apparatus of claim 1, wherein the frame comprises an upper frame and a base frame, wherein the upper frame comprises the first portion of the frame and the base frame comprises the second portion of the frame.

7. The patient support apparatus of claim 6, wherein the control circuitry, when operating in the lockout mode, allows movement of the upper frame to raise the upper frame relative to the base frame and prevents movement of the upper frame to lower the upper frame relative to the base frame.

8. The patient support apparatus of claim 1, further comprising an interface electrically coupled to the control circuitry, the interface displaying an indicator to indicate whether or not the control circuitry is operating in the lockout mode.

9. The patient support apparatus of claim 8, wherein the interface further displays a warning that movement of the first portion of the frame is locked if a user engages the control circuitry to lower the first portion of the frame when the control circuitry is operating in the lockout mode.

10. The patient support apparatus of claim 8, wherein the interface further displays a warning that movement of the first portion of the frame could cause the drainage bag to move to the unwanted position if a user engages the control circuitry to lower of the first portion of the frame when the control circuitry is not operating in the lockout mode.

11. The patient support apparatus of claim 1, further comprising a sensor to sense whether the drainage bag is coupled to the drainage bag support, the control circuitry being placed in the lockout mode automatically in response to the sensor sensing that the drainage bag is coupled to the drainage bag support.

12. The patient support apparatus of claim 1, further comprising a sensor to sense whether the drainage bag is coupled to the drainage bag support, the control circuitry operating to prompt a user to place the control circuitry in the lockout mode in response to the sensor sensing that the drainage bag is coupled to the drainage bag support.

13. The patient support apparatus of claim 1, wherein the unwanted position of the drainage bag comprises the drainage bag touching a floor.

14. The patient support apparatus of claim 1, wherein a user input is coupled to the first portion and is successively engaged by a user to turn the lockout mode on and off.

15. A patient support apparatus comprising:

a frame including a base frame and an upper frame supported above the base frame, the upper frame being pivotally movable to raise and lower relative to the base frame;

a mattress support deck coupled to the upper frame, the mattress support deck having a foot deck section that is movable to raise and lower relative to the upper frame;

a drainage bag support coupled to the foot deck section and configured to support a drainage bag, the drainage bag support having a first rung that is substantially horizontal to a floor when the first portion is raised and a second rung that is angled with respect to the first rung and is substantially horizontal to the floor when the first portion is lowered;

a control circuitry to control movement of the upper frame and the foot deck section, wherein the control circuitry has a lockout mode to limit movement of the upper frame relative to the base frame and to limit movement of the foot deck section, and an indicia positioned adjacent the drainage bag support notifying a caregiver to activate the lockout mode in response to a drainage bag being coupled to the first rung of the drainage bag support so that the upper frame and foot deck section are unable to be moved to place the drainage bag in an unwanted position.

16. The patient support apparatus of claim 15, wherein the control circuitry, when operating in the lockout mode, prevents lowering of the foot deck section if the foot deck section is positioned at an angle greater than 12 degrees with respect to the upper frame.

17. The patient support apparatus of claim 15, wherein the control circuitry, when operating in the lockout mode, allows movement of the upper frame to raise relative to the base frame and prevents movement of the upper frame to lower relative to the base frame.

18. The patient support apparatus of claim 15, further comprising an interface electrically coupled to the control circuitry, the interface displaying an indicator to indicate whether or not the control circuitry is operating in the lockout mode.

19. The patient support apparatus of claim 18, wherein the interface further displays a warning that the control circuitry is operating in the lockout mode if a user engages the control circuitry to lower the upper frame or lower the foot deck section in a manner that is limited by the lockout mode.

20. The patient support apparatus of claim 18, wherein the interface further displays a warning that movement of the upper frame or movement of the foot deck section could cause the drainage bag to move to the unwanted position if a user engages the control circuitry to lower the upper frame or lower the foot deck section when the control circuitry is not operating in the lockout mode.

21. The patient support apparatus of claim 15, further comprising a sensor to sense whether the drainage bag is coupled to the drainage bag support, the control circuitry being placed in the lockout mode automatically in response to the sensor sensing that the drainage bag is coupled to the drainage bag support.

22. The patient support apparatus of claim 15, further comprising a sensor to sense whether the drainage bag is coupled to the drainage bag support, the control circuitry operating to prompt a user to place the control circuitry in the lockout mode in response to the sensor sensing that the drainage bag is coupled to the drainage bag support.

23. The patient support apparatus of claim 15, wherein the unwanted position of the drainage bag comprises the drainage bag touching a floor.

24. The patient support apparatus of claim 15, wherein a user input is coupled to the upper frame and is successively engaged by a user to turn the lockout mode on and off.

* * * * *